US012779621B2

(12) United States Patent
Kao et al.

(10) Patent No.: US 12,779,621 B2
(45) Date of Patent: Nov. 3, 2026

(54) CYLINDRICAL GRINDER

(71) Applicant: OKUMA CORPORATION, Niwa-gun (JP)

(72) Inventors: Takuya Kao, Niwa-gun (JP); Takashi Nishimoto, Niwa-gun (JP)

(73) Assignee: OKUMA CORPORATION, Niwa-gun (JP)

( * ) Notice: Subject to any disclaimer, the term of this patent is extended or adjusted under 35 U.S.C. 154(b) by 346 days.

(21) Appl. No.: 18/386,305

(22) Filed: Nov. 2, 2023

(65) Prior Publication Data

US 2024/0139904 A1 May 2, 2024

(30) Foreign Application Priority Data

Nov. 2, 2022 (JP) ..... 2022-176216

(51) Int. Cl.
*B24B 41/06* (2012.01)
*B24B 41/02* (2006.01)

(52) U.S. Cl.
CPC ..... *B24B 41/061* (2013.01); *B24B 41/02* (2013.01)

(58) Field of Classification Search
CPC ..... B23Q 1/76; B23Q 11/08; B23Q 11/0825; B23Q 2011/0808; B24B 5/04; B24B 41/02; B24B 41/06; B24B 41/061; B24B 41/065; B24B 41/068
See application file for complete search history.

(56) References Cited

U.S. PATENT DOCUMENTS 3,140,626 A * 7/1964 Davies, Jr. ..... B23Q 1/76 82/124
5,583,647 A * 12/1996 Izor ..... B41C 1/045 358/3.32

(Continued)

FOREIGN PATENT DOCUMENTS

JP S59-112546 U 7/1984
JP S62-74562 A 4/1987

(Continued)

OTHER PUBLICATIONS

Notice of Reasons for Refusal mailed Jan. 20, 2026, issued in the corresponding JP patent application No. 2022-176216 and its machine translation.

*Primary Examiner* — Sang K Kim
(74) *Attorney, Agent, or Firm* — Troutman Pepper Locke LLP

(57) ABSTRACT

Provided is a cylindrical grinder that is capable of automatically moving and fixing a tailstock in accordance with variations in length of a workpiece and enables improvement in its productivity. An NC cylindrical grinder includes: a table as a base; a headstock and an NC tailstock both arranged on the table; a moving mechanism configured to move at least either one of the headstock and the tailstock in a Z-axis direction; and a protective cover provided to the table and configured to protect the moving mechanism. In an area between the headstock and the tailstock and at a height position above the protective cover, a tooling base for mounting a tooling instrument thereon is arranged in a freely movable manner in the Z-axis direction. Provided is a guide mechanism for guiding the tooling base in the Z-axis direction and fixing the tooling base to the table at a required position.

5 Claims, 13 Drawing Sheets

(56) References Cited

U.S. PATENT DOCUMENTS

| | | | | |
|---|---|---|---|---|
| 6,827,631 | B2 * | 12/2004 | Tomotaki | B24B 47/12<br>409/165 |
| 6,868,304 | B2 * | 3/2005 | Uehara | B23B 5/48<br>700/95 |
| 7,503,244 | B2 * | 3/2009 | Nakamura | B23Q 1/015<br>82/149 |
| 8,408,967 | B2 * | 4/2013 | Ido | B23Q 1/76<br>451/181 |

FOREIGN PATENT DOCUMENTS

| | | | |
|---|---|---|---|
| JP | S62-255043 | A | 11/1987 |
| JP | H06-39349 | U | 5/1994 |
| JP | 2511775 | B2 | 7/1996 |
| JP | 2000-94246 | A | 4/2000 |

* cited by examiner

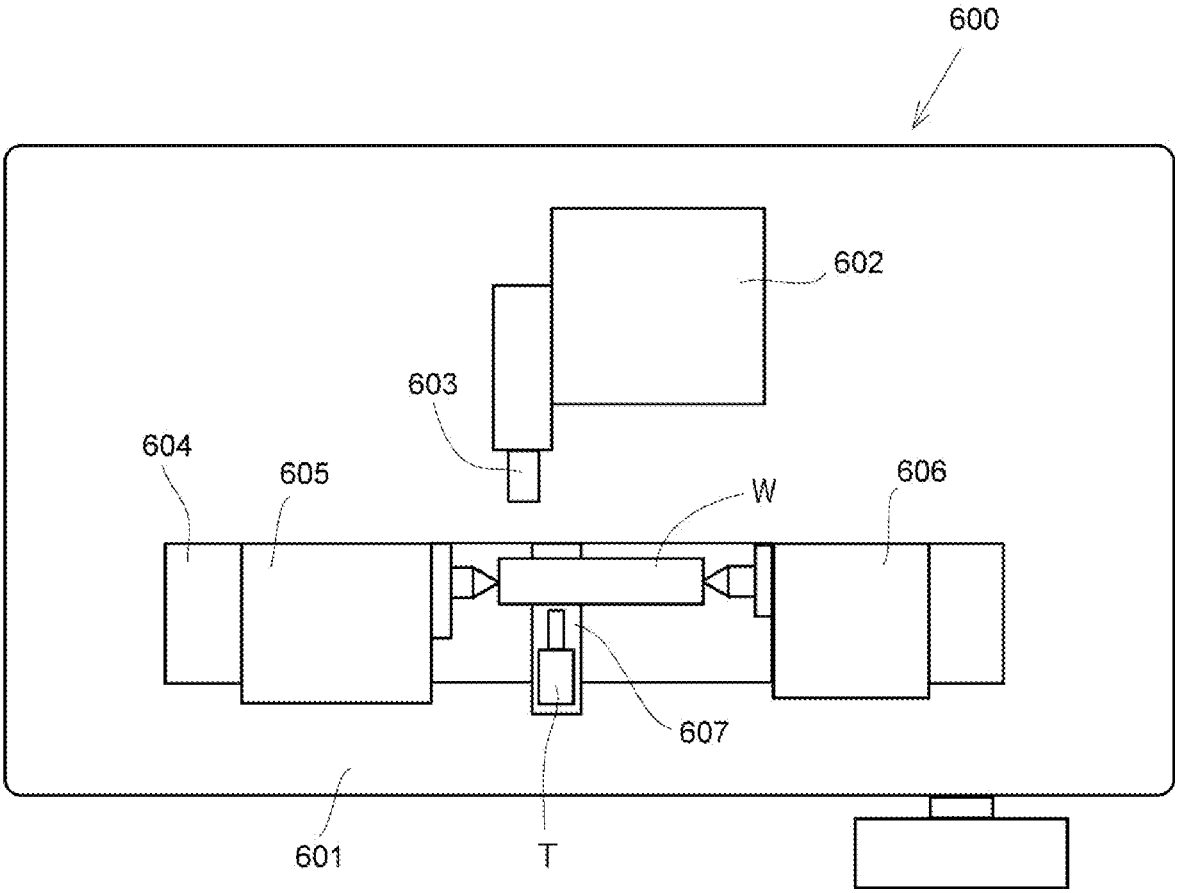
*FIG. 11 [Prior Art]*

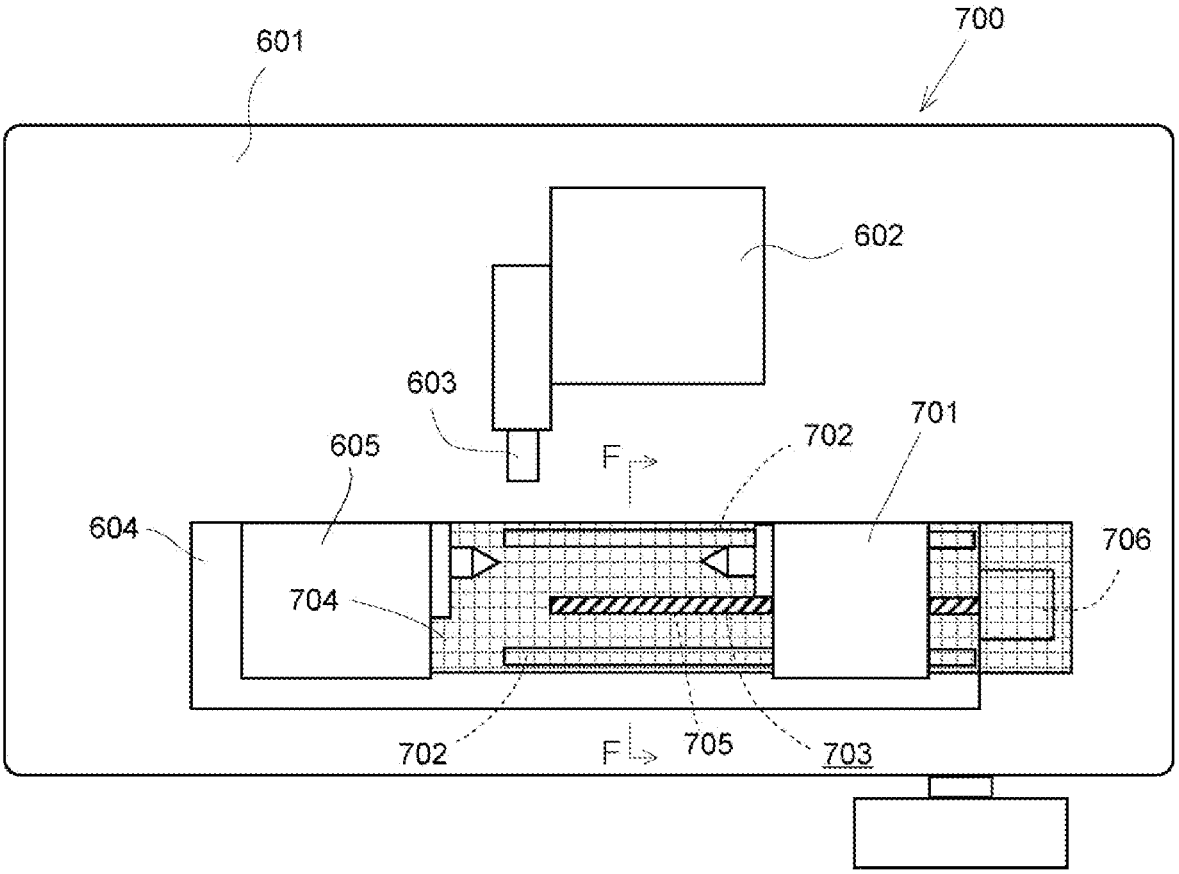
*FIG. 12 [Prior Art]*

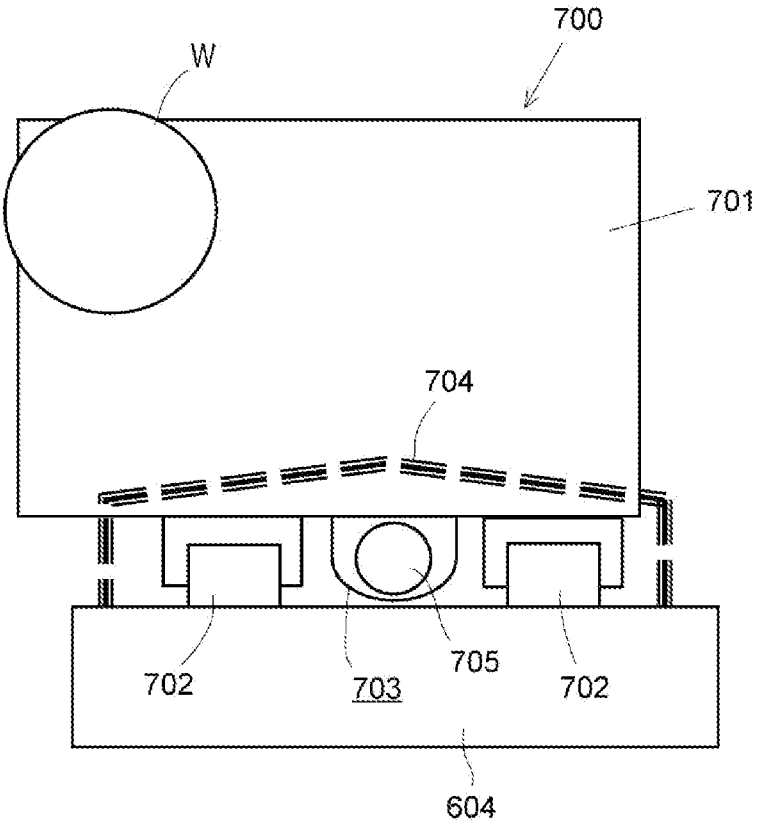
*FIG. 13 [Prior Art]*

CYLINDRICAL GRINDER

DETAILED DESCRIPTION OF THE PRESENT INVENTION

Technical Field

The present invention relates to a cylindrical grinder.

In the following description, the lower side of FIG. 1, FIG. 3, FIG. 5, FIG. 7, FIG. 9, FIG. 11, and FIG. 12 will be referred to as a "front" side, the opposite side thereto will be referred to as a "rear" side, and the left and right sides of these drawings will be referred to as "left" and "right" sides, respectively. Also, the upper and lower sides of FIG. 2, FIG. 4, FIG. 6, FIG. 8, FIG. 10, and FIG. 13 will be referred to as "upper" and "lower" sides, respectively.

BACKGROUND ART

A conventional cylindrical grinder 600 including a standard tailstock is shown in FIG. 11. In FIG. 11, the cylindrical grinder 600 includes: a bed 601; a wheel spindle stock 602 arranged on the bed 601 so as to be movable in an X-axis direction (up-down direction in FIG. 11); a wheel spindle (tool spindle) that is freely rotatable, is provided to the wheel spindle stock 602, and is configured to hold, at a distal end of the wheel spindle, a grinding wheel 603; a wheel spindle motor (tool spindle motor) configured to rotate the wheel spindle; a table 604 arranged in front of the wheel spindle stock 602 (toward an operator side from the wheel spindle stock 602) and on the bed 601, so as to be movable in a Z-axis direction (left-right direction); a headstock 605 arranged on the table 604 and configured to hold one end of a workpiece W; a tailstock 606 arranged on the table 604 and configured to hold the other end of the workpiece W; and a tooling base 607 which is arranged between the headstock 605 and tailstock 606 that are on the table 604 and on which a tooling instrument T such as a sizing device or a workpiece rest is mounted. In this cylindrical grinder 600, the tooling base 607, as well as the headstock 605 and the tailstock 606, is configured to be manually moved in the Z-axis direction and fixed according to the length of the workpiece W.

In the cylindrical grinder, as for the tailstock, using an NC tailstock that is capable of being automatically moved in the Z-axis direction according to the length of a workpiece to be machined is being considered. FIG. 12 and FIG. 13 show an example of an NC cylindrical grinder including an NC tailstock that is numerically controlled. In FIG. 12 and FIG. 13, a cylindrical grinder 700 of this type includes: an NC tailstock 701 arranged on the table 604 so as to be movable in the Z-axis direction and configured to hold an end portion of the workpiece W at a side thereof opposite to a side held by the headstock 605; a pair of front and rear guide rails 702 extending in the Z-axis direction and configured to guide the NC tailstock 701; a moving mechanism 703 configured to move the NC tailstock 701 in the Z-axis direction, which is an axial direction of a workpiece W, along the guide rails 702 by means of numerical control; and a protective cover 704 configured to protect the guide rails 702 and the moving mechanism 703 from a coolant or the like. The moving mechanism 703 consists of: a ball screw 705 consisting of a ball screw shaft arranged between both of the guide rails 702 and extending in the Z-axis direction, and a ball nut that is screw-fitted to the ball screw shaft with a plurality of balls interposed therebetween; and a motor 706 arranged to the right side of the NC tailstock 701 and configured to rotate the ball screw shaft of the ball screw 705. The motor 706 becomes numerically controlled by means of a control device not shown. The other configuration is the same as that of the cylindrical grinder 600 shown in FIG. 11, and the same components are denoted by the same reference signs.

SUMMARY OF THE INVENTION

Problem to be Solved by the Invention

However, because the cylindrical grinder 600 shown in FIG. 11 is configured to manually move, as well as the headstock 605 and the tooling base 607, the tailstock 606 in the Z-axis direction and fix it according to the length of the workpiece W, the work for the movement and fixation was troublesome.

In addition, although the NC cylindrical grinder 700 shown in FIG. 12 and FIG. 13 is capable of automatically moving the NC tailstock 701 in the Z-axis direction and fix it according to the length of the workpiece W, thereby facilitating the work, there arises a problem that a tooling base on which a tooling instrument such as a sizing device or a workpiece rest is mounted cannot be mounted on the table 604 because the guide rails 702, the moving mechanism 703, and the protective cover 704 configured to protect the guide rails 702 and the moving mechanism 703 from a coolant or the like are provided on the table 604. Generally, in the cylindrical grinder, the frequency of attaching the tooling instrument is high, and therefore, being unable to mount a tooling base on the table is a fatal issue. Under such a circumstance, the NC tailstock, which is being commonly used for lathes, does not become widespread for cylindrical grinders, causing a factor inhibiting productivity enhancement by cylindrical grinders.

An object of the present invention is to overcome the above-described problems and to provide a cylindrical grinder that is capable of automatically moving and fixing the tailstock in accordance with variations in length of the workpiece, and enables improvement in its productivity.

Means for Solving the Problem

In order to achieve the above object, the present invention consists of the following aspects.

1) A cylindrical grinder including: a base; a headstock arranged on said base and configured to rotatably support one end of a workpiece; a tailstock arranged on said base and configured to rotatably support the other end of said workpiece; a moving mechanism provided to said base and configured to move at least either one of said headstock and said tailstock in a Z-axis direction, which is an axial direction of said workpiece; and a protective cover provided on said base and configured to protect said moving mechanism, wherein in an area between said headstock and said tailstock and at a height position above said protective cover, a tooling base for mounting a tooling instrument thereon is arranged in a freely movable manner in said Z-axis direction, and between said base and said tooling base, a guide mechanism being capable of guiding said tooling base in said Z-axis direction and fixing said tooling base to said base at a required position is provided.

2) The cylindrical grinder according to the above aspect 1), wherein to at least either one of a part toward an operator side beyond said protective cover and a part toward an anti-operator side beyond said protective cover, of said tooling base, a leg part extending downward is provided in a fixed manner, and said guide mechanism includes:

a guide groove formed on an upper surface of said base and extending in said Z-axis direction;

a clamp piece fitted in said guide groove in a freely movable manner in said Z-axis direction; and a clamp bolt provided to said leg part of said tooling base and configured to fix said clamp piece at a required position in said guide groove and fix said tooling base to said base.

3) The cylindrical grinder according to the above aspect 1), wherein at at least either one of a portion toward an operator side beyond said protective cover and a portion toward an anti-operator side beyond said protective cover, both on an upper surface of said base, a support member protruding upward and configured to support said tooling base is provided in a fixed manner, and said guide mechanism includes:

a guide groove formed on an upper surface of said support member and extending in said Z-axis direction;

a clamp piece fitted in said guide groove in a freely movable manner in said Z-axis direction; and a clamp bolt provided to said tooling base and configured to fix said clamp piece at a required position in said guide groove and fix said tooling base to said base.

4) The cylindrical grinder according to the above aspect 1), wherein to either one of a part toward an operator side beyond said protective cover and a part toward an anti-operator side beyond said protective cover, of said tooling base, a leg part extending downward is provided in a fixed manner, at either one of a portion toward the operator side beyond said protective cover and a portion toward the anti-operator side beyond said protective cover, both on an upper surface of said base, a support member protruding upward and configured to support said tooling base is provided in a fixed manner, with the support member being provided at the portion where the leg part is not provided, and said guide mechanism includes:

a first guide groove formed on the upper surface of said base and extending in said Z-axis direction;

a first clamp piece fitted in said first guide groove in a freely movable manner in said Z-axis direction;

a first clamp bolt provided to said leg part of said tooling base and configured to fix said first clamp piece at a required position in said first guide groove and fix said tooling base to said base;

a second guide groove formed on an upper surface of said support member and extending in said Z-axis direction;

a second clamp piece fitted in said second guide groove in a freely movable manner in said Z-axis direction; and a second clamp bolt provided to said tooling base and configured to fix said second clamp piece at a required position in said second guide groove and fix said tooling base to said base.

5) The cylindrical grinder according to the above aspect 1), wherein said base is a table provided on a bed.

Advantageous Effects of the Invention

According to the cylindrical grinder of the above aspects 1) to 5), the tooling base for the tooling instrument, on which the tooling instrument such as a sizing device or a workpiece rest is mounted, is arranged in a freely movable manner in the Z-axis direction, in an area between the headstock and the tailstock, and at a height position above the protective cover with a gap being provided between the tooling base and the protective cover. Therefore, even if the protective cover configured to protect the moving mechanism for the tailstock, which consists of a ball screw and a motor configured to actuate the ball screw, from a coolant or the like is provided, the tooling base can be provided in a freely movable manner in the Z-axis direction according to the length of the workpiece without interfering with the protective cover. Furthermore, the guide mechanism is capable of guiding the tooling base in the Z-axis direction and fixing the tooling base to the base at a required position. As a result, it becomes possible to use the cylindrical grinder of the above aspects 1) to 5) as an NC cylindrical grinder including: the tooling base to be moved in the Z-axis direction and to be fixed according to the length of the workpiece to be machined; and the NC tailstock to be automatically moved in the Z-axis direction and to be fixed according to the length of the workpiece to be machined, whereby its productivity is improved.

According to the cylindrical grinder of the above aspects 2) to 4), it becomes possible to arrange, relatively simply, the tooling base in a freely movable manner in the Z-axis direction, in an area between the headstock and the tailstock and at a height position above the protective cover with a gap provided between the tooling base and the protective cover, and the configuration of the guide mechanism also becomes relatively simple.

BRIEF DESCRIPTION OF THE DRAWINGS

FIG. 11 is a schematic plan view showing a conventional cylindrical grinder including a standard tailstock.

FIG. 12 is a schematic plan view showing a conventional NC cylindrical grinder including an NC tailstock, with a workpiece being omitted.

FIG. 13 is an enlarged sectional view taken along line F-F of FIG. 12.

DESCRIPTION OF EMBODIMENTS

In the followings, embodiments of the present invention will be described with reference to the drawings.

In the following description, same components and same parts will be denoted by the same reference signs.

Embodiment 1

Figure 1:
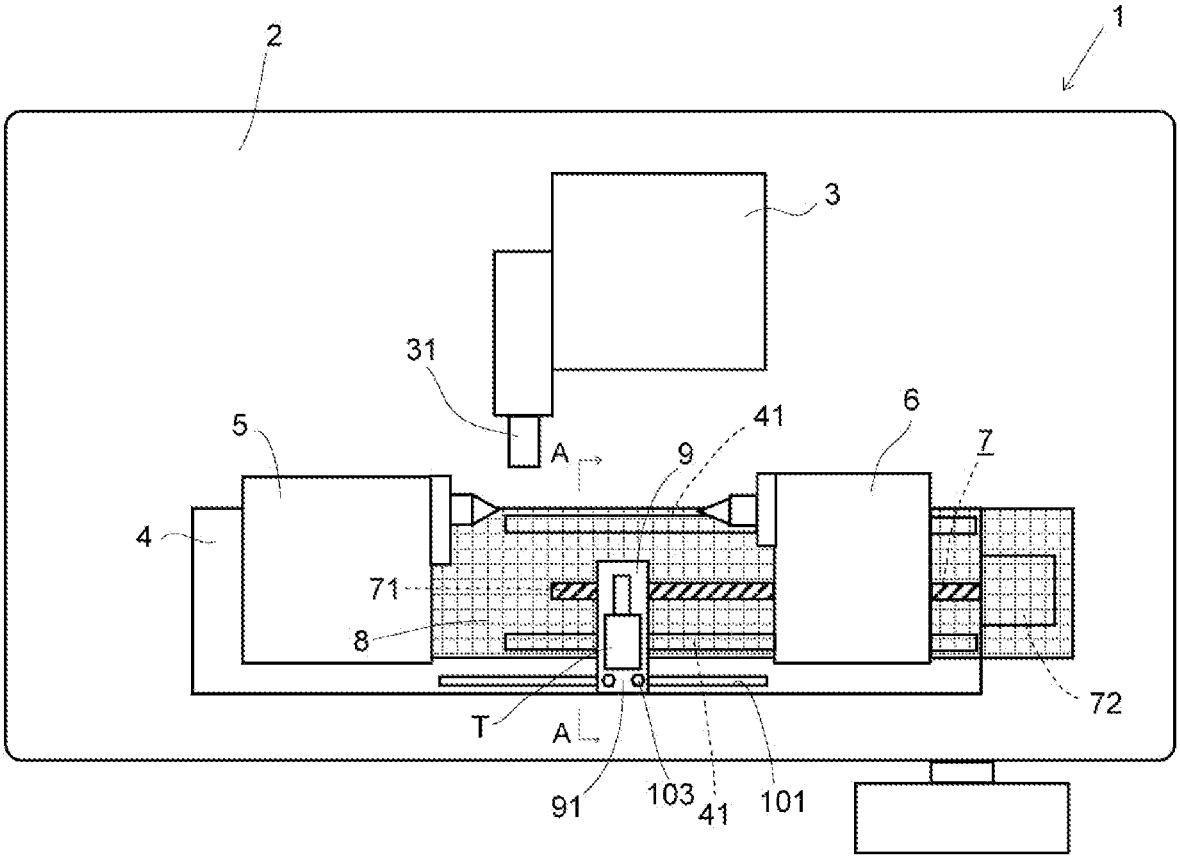
FIG. 1 is a schematic plan view showing an NC cylindrical grinder of Embodiment 1 of the present invention, with a workpiece being omitted.
Figure 2:
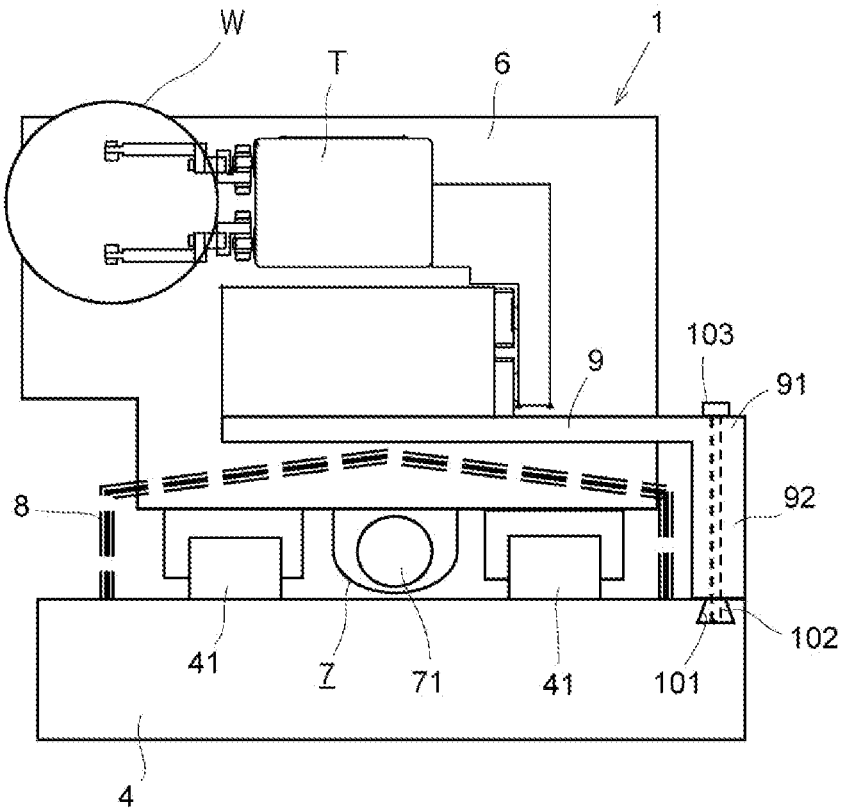
FIG. 2 is an enlarged sectional view taken along line A-A of FIG. 1.

Embodiment 1 is shown in FIG. 1 and FIG. 2. FIG. 1 and FIG. 2 schematically show the overall configuration of an NC cylindrical grinder.

In FIG. 1 and FIG. 2, an NC cylindrical grinder 1 includes: a bed 2; a wheel spindle stock 3 arranged on the bed 2 so as to be movable in an X-axis direction (up-down direction in FIG. 1), and having a wheel spindle (not shown) that is freely rotatable and is configured to hold a grinding wheel 31; a table 4, as a base, which is arranged on the bed 2 and in front of the wheel spindle stock 3 (toward the operator side from the wheel spindle stock 3) so as to be movable in a Z-axis direction (left-right direction); a headstock 5 arranged on the table 4 and configured to hold one end of a workpiece W; an NC tailstock 6 arranged on the table 4 in a freely movable manner in the Z-axis direction, which is an axial direction of the workpiece W, configured to hold the other end of the workpiece W, and configured to be moved in the Z-axis direction and to be fixed according to the length of the workpiece W to be machined; a moving mechanism 7 configured to move the NC tailstock 6 in the Z-axis direction by means of numerical control; a protective cover 8 configured to protect the moving mechanism 7 from a coolant or the like; a tooling base 9 for mounting a tooling instrument thereon, which is arranged in a freely movable manner in the Z-axis direction, in an area between the headstock 5 and the NC tailstock 6 and at a height position above the protective cover 8, and on which a tooling instrument T is mounted; and a guide mechanism being capable of guiding the tooling base 9 in the Z-axis direction and fixing the tooling base 9 to the table 4 at a required position.

On the table 4, at a portion near a front end thereof and a portion near a rear end thereof, guide rails 41 extending in Z-axis direction are provided. The NC tailstock 6 is attached to both of the guide rails 41 so as to straddle a space between the guide rails 41 and is configured to move in the Z-axis direction along both of the guide rails 41. The moving mechanism 7 consists of a ball screw 71 and a motor 72. The ball screw 71 consists of: a ball screw shaft arranged between both of the guide rails 41 and extending in the Z-axis direction; and a ball nut that is screw-fitted to the ball screw shaft with a plurality of balls interposed therebetween. The motor 72 is arranged to the right side of the NC tailstock 6 and is configured to rotate the ball screw shaft of the ball screw 71. The motor 72 is configured to be numerically controlled by a control device not shown. The protective cover 8 covers both of the guide rails 41, the ball screw 71, and the motor 72.

The tooling base 9 is provided with at least either one of a part protruding toward the operator side beyond the protective cover 8 and a part protruding toward an anti-operator side beyond the protective cover 8. And here in the drawings, the tooling base 9 is provided with a forwardly protruding part 91 that protrudes toward the operator side. The forwardly protruding part 91 is integrally provided with a leg part 92 protruding downward.

The guide mechanism capable of guiding the tooling base 9 in the Z-axis direction and fixing the tooling base 9 to the table 4 at a required position includes: a guide groove 101 having the shape of a dovetail groove, formed at at least either one of a portion toward the operator side beyond the protective cover 8 and a portion toward the anti-operator side beyond the protective cover 8, both on an upper surface of the table 4, and in this embodiment as shown in the drawings, formed at the portion toward the operator side (front side), and extending in the Z-axis direction; a clamp piece 102 fitted in the guide groove 101 in a freely movable manner in the Z-axis direction; and a clamp bolt 103 penetrating the forwardly protruding part 91 and the leg part 92 of the tooling base 9 in the up-down direction and configured to fix the clamp piece 102 at a required position in the guide groove 101 and fix the tooling base 9 to the table 4.

In the cylindrical grinder 1 described above, the NC tailstock 6 is moved by the moving mechanism 7 in the Z-axis direction along the guide rails 41 and is fixed at a required position, according to the length of the workpiece W to be machined. The protective cover 8 expands and contracts in association with the movement of the NC tailstock 6 in some cases, and slides into a space provided below the headstock 5 in association with the movement of the NC tailstock 6 in other cases. The tooling base 9 is configured to be moved in the Z-axis direction, in a state where the clamp bolt 103 is loosened and the clamp piece 102 is slidable in the guide groove 101. At a required position according to the length of the workpiece W to be machined, tightening the clamp bolt 103 causes the clamp piece 102 to be fixed in the guide groove 101, whereby the tooling base 9 is fixed to the table 4.

Embodiment 2

Figure 3:
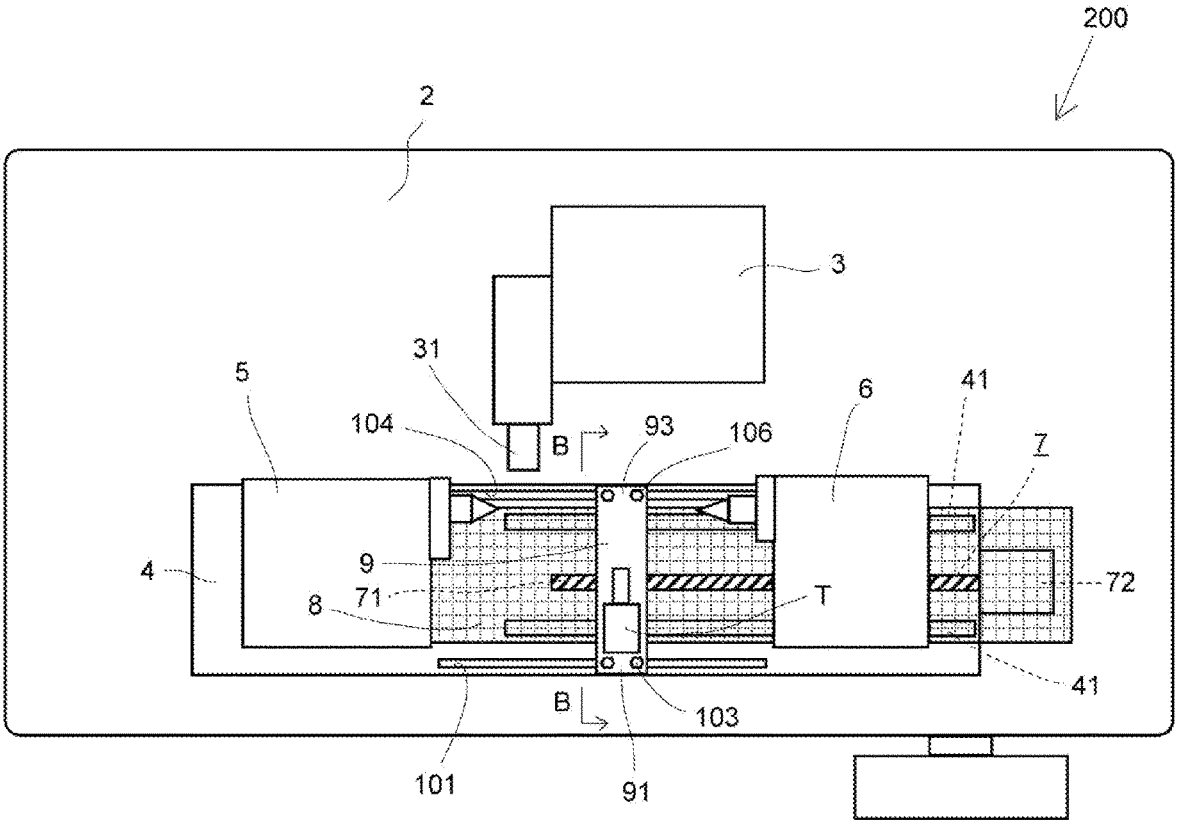
FIG. 3 is a schematic plan view showing an NC cylindrical grinder of Embodiment 2 of the present invention, with a workpiece being omitted.
Figure 4:
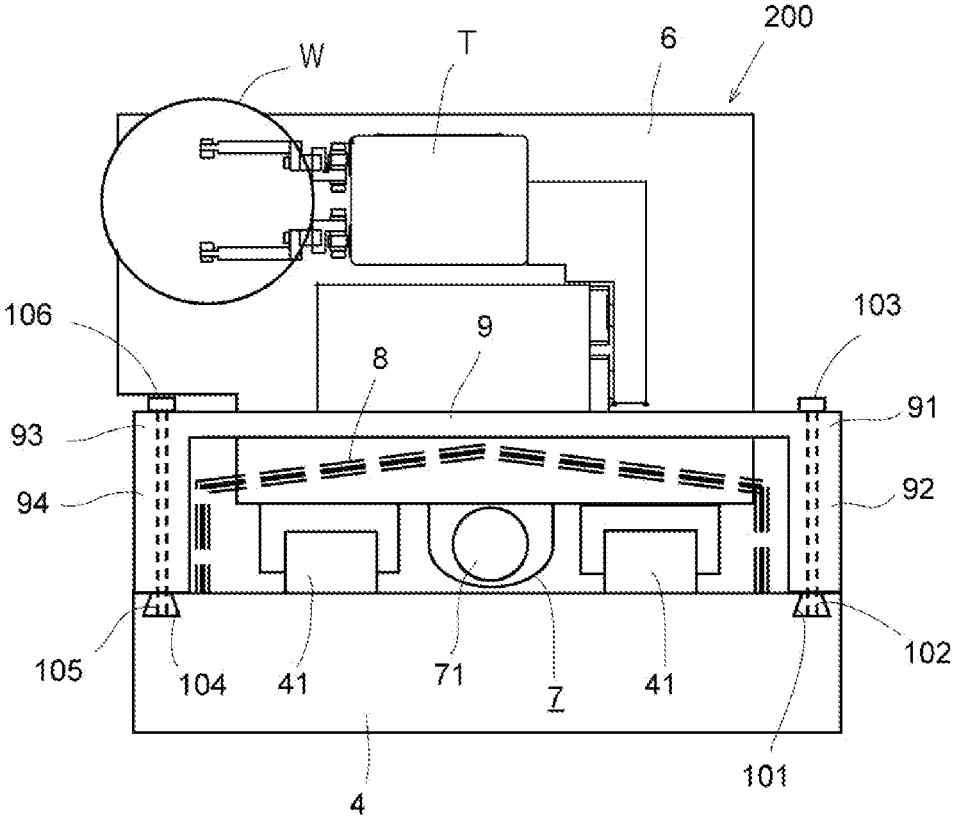
FIG. 4 is an enlarged sectional view taken along line B-B of FIG. 3.

Embodiment 2 is shown in FIG. 3 and FIG. 4. FIG. 3 and FIG. 4 schematically show the overall configuration of an NC cylindrical grinder.

In an NC cylindrical grinder 200 shown in FIG. 3 and FIG. 4, the tooling base 9 is provided with, in addition to the forwardly protruding part 91 protruding toward the operator side beyond the protective cover 8, a backwardly protruding part 93 protruding toward the anti-operator side beyond the protective cover 8, and the backwardly protruding part 93 is also integrally provided with a leg part 94.

The guide mechanism capable of guiding the tooling base 9 in the Z-axis direction and fixing the tooling base 9 to the table 4 at a required position includes, in addition to the guide groove 101 in front of the protective cover 8, a clamp piece 102 fitted in the guide groove 101, and a clamp bolt 103 configured to fix the clamp piece 102: a guide groove 104 having the shape of a dovetail groove, formed on the upper surface of the table 4 and toward the anti-operator side (rear side) beyond the protective cover 8, and extending in the Z-axis direction; a clamp piece 105 fitted in the guide groove 104 in a freely movable manner in the Z-axis direction; and a clamp bolt 106 penetrating the backwardly protruding part 93 and the leg part 94 of the tooling base 9 in the up-down direction and configured to fix the clamp piece 105 at a required position in the guide groove 104 and fix the tooling base 9 to the table 4.

The other configuration is the same as that of the NC cylindrical grinder 1 of Embodiment 1. The tooling base 9 is guided in the Z-axis direction and is fixed at a required position, in the same manner as in the NC cylindrical grinder 1 of Embodiment 1.

According to the NC cylindrical grinder 200 of Embodiment 2, because the tooling base 9 is supported, at both of front and rear end portions thereof, by the leg parts 92, 94, support rigidity of the tooling base 9 is improved as compared with the NC cylindrical grinder 1 of Embodiment 1.

Embodiment 3

Figure 5:
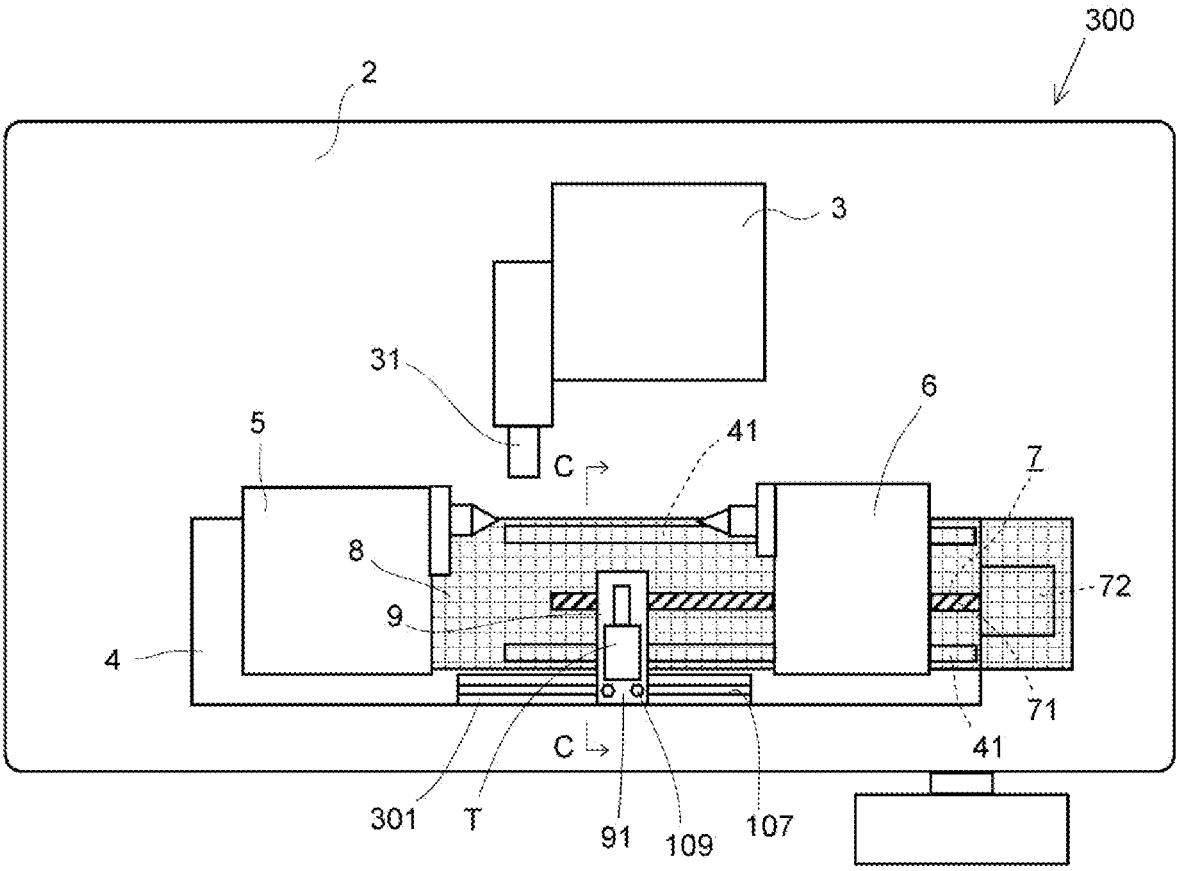
FIG. 5 is a schematic plan view showing an NC cylindrical grinder of Embodiment 3 of the present invention, with a workpiece being omitted.
Figure 6:
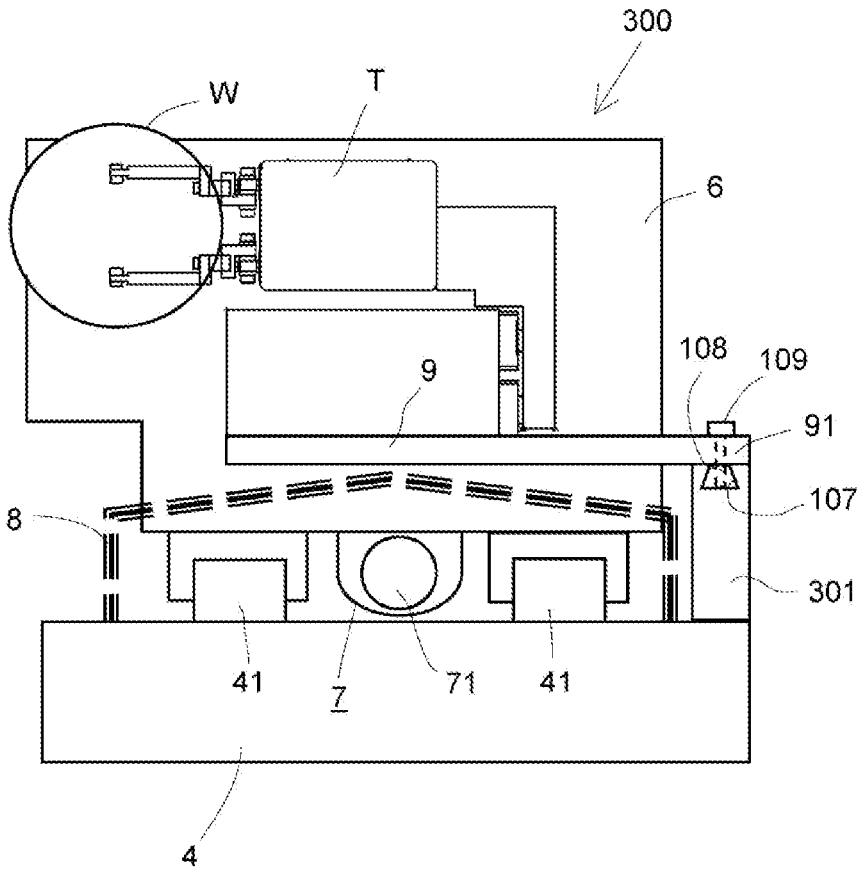
FIG. 6 is an enlarged sectional view taken along line C-C of FIG. 5.

Embodiment 3 is shown in FIG. 5 and FIG. 6. FIG. 5 and FIG. 6 schematically show the overall configuration of an NC cylindrical grinder.

In an NC cylindrical grinder 300 shown in FIG. 5 and FIG. 6, at at least either one of a portion toward an operator side beyond the protective cover 8 and a portion toward an anti-operator side beyond the protective cover 8, both on the upper surface of the table 4, and in this embodiment as shown in the drawings, at the portion toward the operator side (front side) and below the forwardly protruding part 91, a support member 301 protruding upward is provided in a fixed manner.

The guide mechanism capable of guiding the tooling base 9 in the Z-axis direction and fixing the tooling base 9 to the table 4 at a required position includes: a guide groove 107 having the shape of a dovetail groove, formed on an upper surface of the support member 301, and extending in the Z-axis direction; a clamp piece 108 fitted in the guide groove 107 in a freely movable manner in the Z-axis direction; and a clamp bolt 109 provided so as to penetrate the forwardly protruding part 91 of the tooling base 9 in the up-down direction, and configured to fix the clamp piece 108 at a required position in the guide groove 107 and fix the tooling base 9 to the table 4.

The other configuration is the same as that of the NC cylindrical grinder 1 of Embodiment 1.

In the cylindrical grinder 300 described above, the NC tailstock 6 is moved in the Z-axis direction along the guide rails 41 according to the length of a workpiece W to be machined, and is fixed at a required position. The protective cover 8 expands and contracts in association with the movement of the NC tailstock 6 in some cases, and slides into a space provided below the headstock 5 in association with the movement of the NC tailstock 6 in other cases. The tooling base 9 is configured to be moved in the Z-axis direction, in a state where the clamp bolt 109 is loosened and the clamp piece 108 is slidable in the guide groove 107. At a required position according to the length of the workpiece W to be machined, tightening the clamp bolt 109 causes the clamp piece 108 to be fixed in the guide groove 107, whereby the tooling base 9 is fixed to the table 4.

Embodiment 4

Figure 7:
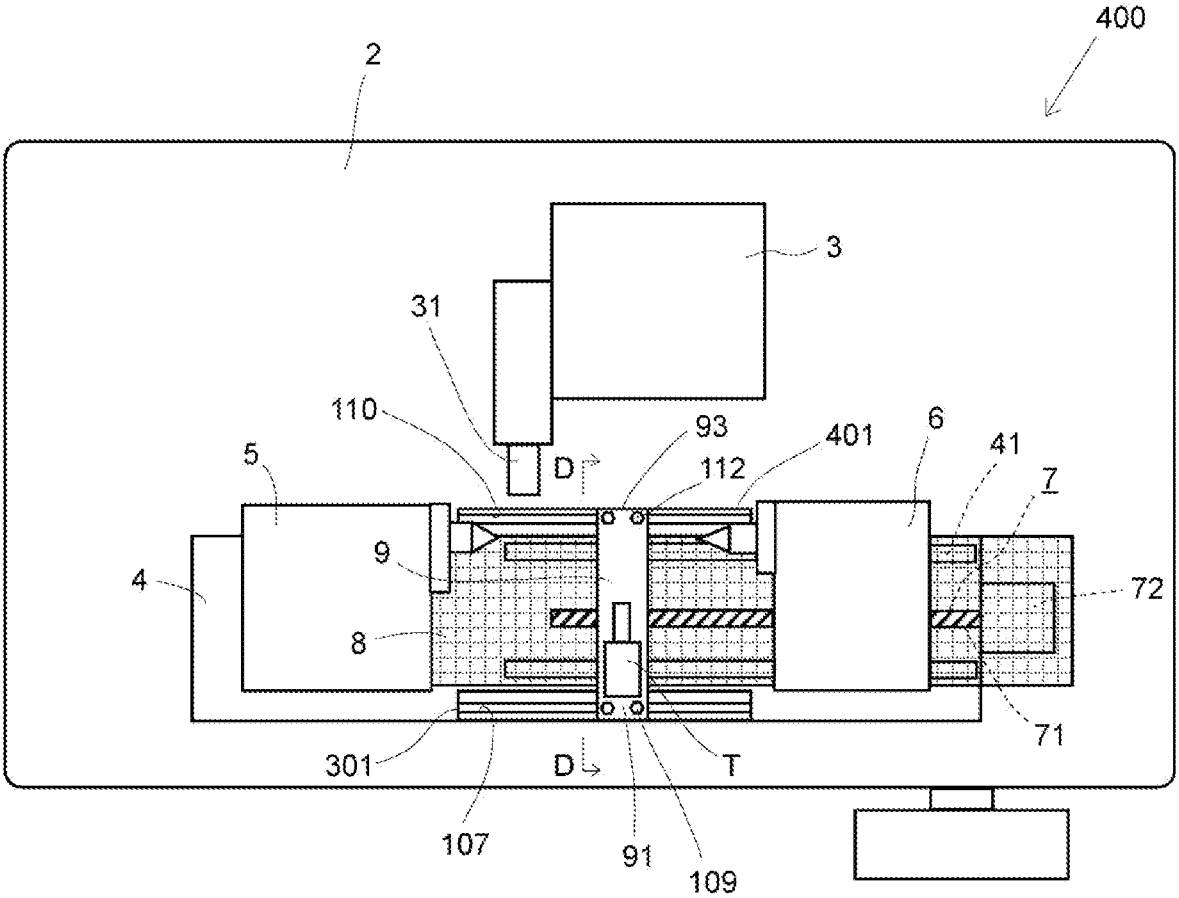
FIG. 7 is a schematic plan view showing an NC cylindrical grinder of Embodiment 4 of the present invention, with a workpiece being omitted.
Figure 8:
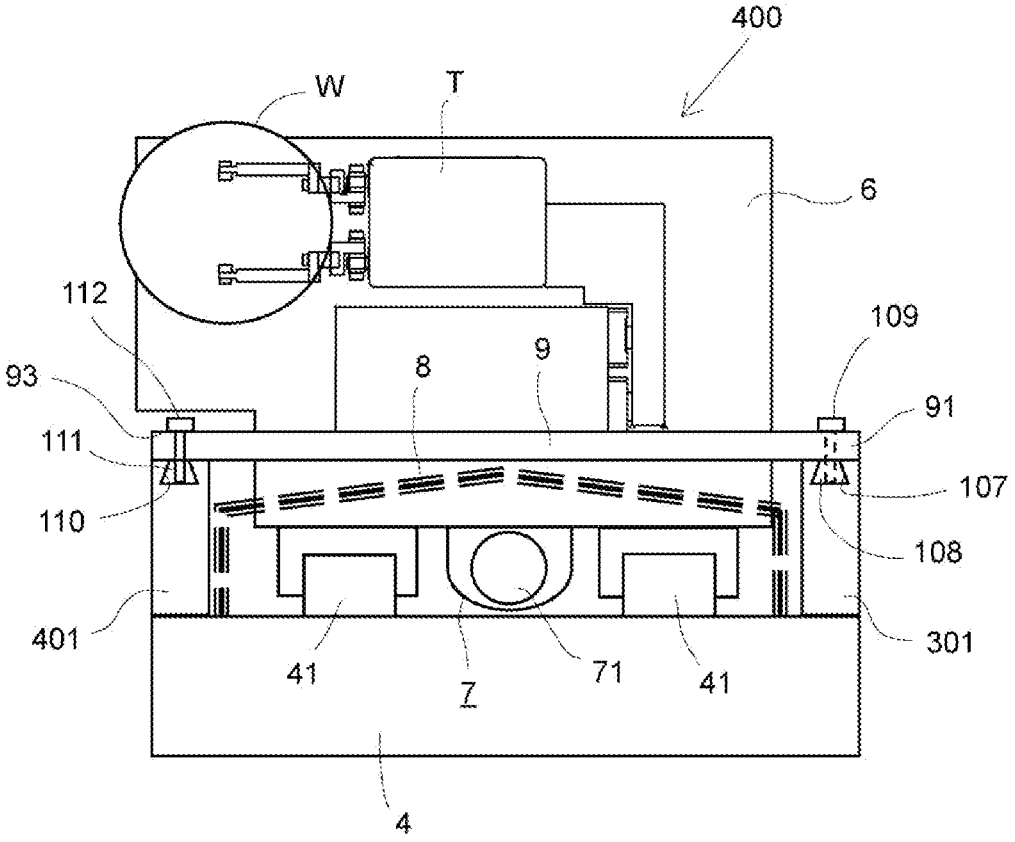
FIG. 8 is an enlarged sectional view taken along line D-D of FIG. 7.

Embodiment 4 is shown in FIG. 7 and FIG. 8. FIG. 7 and FIG. 8 schematically show the overall configuration of an NC cylindrical grinder.

In an NC cylindrical grinder 400 shown in FIG. 7 and FIG. 8, the table 4 includes, in addition to the support member 301 protruding upward and provided in a fixed manner at a portion toward the operator side beyond the protective cover 8, a support member 401 protruding upward and provided in a fixed manner at a portion toward the anti-operator side beyond the protective cover 8 and below the backwardly protruding part 93.

The guide mechanism capable of guiding the tooling base 9 in the Z-axis direction and fixing the tooling base 9 to the table 4 at a required position includes, in addition to the guide groove 107 on the support member 301, a clamp piece 108 fitted in the guide groove 107, and a clamp bolt 109 configured to fix the clamp piece 108: a guide groove 110 formed on the upper surface of the support member 401 at the rear side; a clamp piece 111 fitted in the guide groove 110 in a freely movable manner in the Z-axis direction; and a clamp bolt 112 provided so as to penetrate the backwardly protruding part 93 of the tooling base 9 in the up-down direction and configured to fix the clamp piece 111 at a required position in the guide groove 110 and fix the tooling base 9 to the table 4.

The other configuration is the same as that of the NC cylindrical grinder 300 of Embodiment 3. The tooling base 9 is guided in the Z-axis direction and is fixed at a required position, in the same manner as in the NC cylindrical grinder 300 of Embodiment 3.

According to the NC cylindrical grinder 400 of Embodiment 4, because the tooling base 9 is supported, at both of the front and rear end portions thereof, by the support members 301, 401, support rigidity of the tooling base 9 is improved as compared with the NC cylindrical grinder 300 of Embodiment 3.

Embodiment 5

Figure 9:
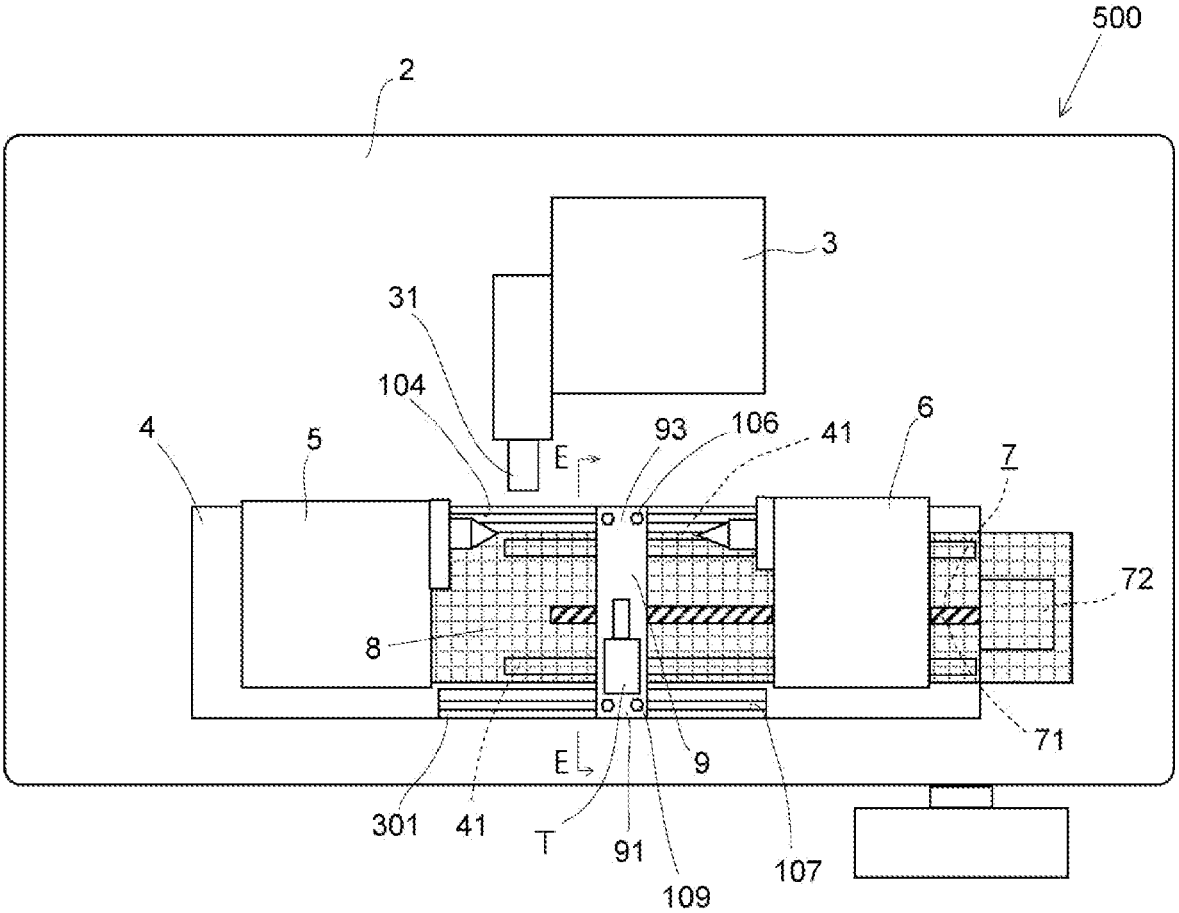
FIG. 9 is a schematic plan view showing an NC cylindrical grinder of Embodiment 5 of the present invention, with a workpiece being omitted.
Figure 10:
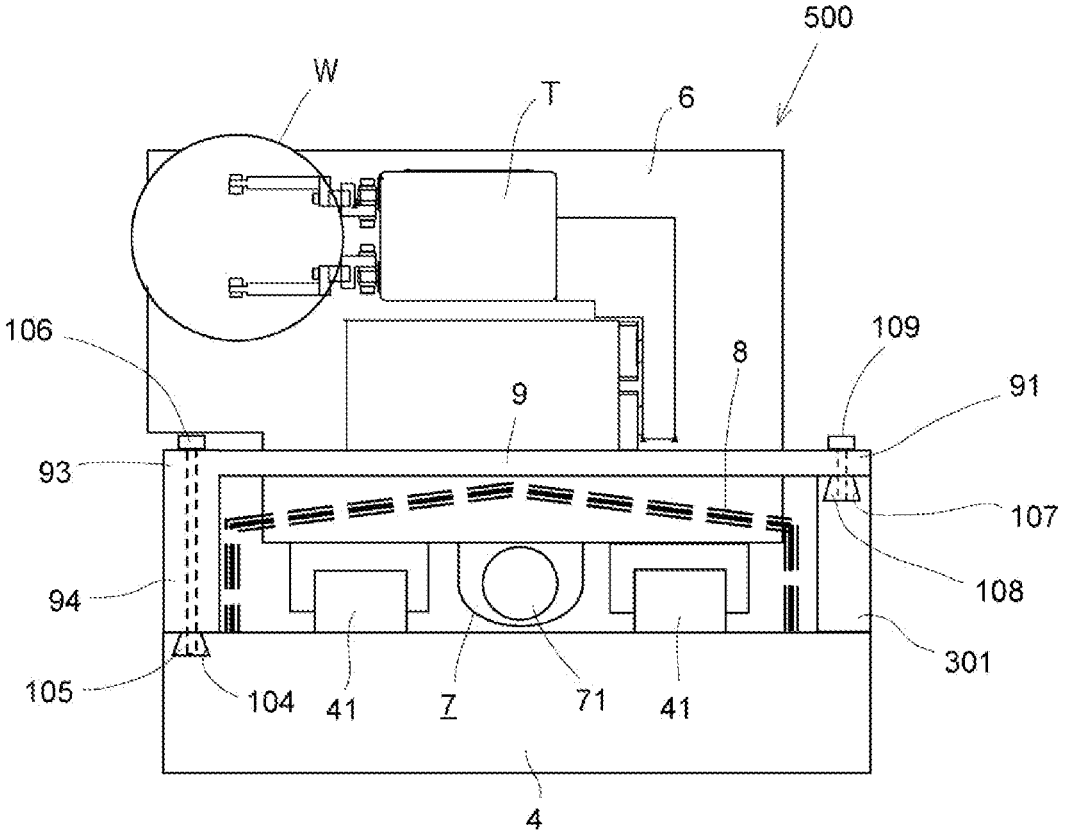
FIG. 10 is an enlarged sectional view taken along line E-E of FIG. 9.

Embodiment 5 is shown in FIG. 9 and FIG. 10. FIG. 9 and FIG. 10 schematically show the overall configuration of an NC cylindrical grinder.

In an NC cylindrical grinder 500 shown in FIG. 9 and FIG. 10, the table 4 is provided, on a portion thereof toward the operator side beyond the protective cover 8, with a support member 301 protruding upward and provided in a fixed manner and below the forwardly protruding part 91. In addition, the tooling base 9 includes a backwardly protruding part 93 protruding toward the anti-operator side beyond the protective cover 8 and a leg part 94 integrally provided with the backwardly protruding part 93.

The guide mechanism capable of guiding the tooling base 9 in the Z-axis direction and fixing the tooling base 9 to the table 4 at a required position includes: a guide groove 107 on the support member 301; a clamp piece 108 fitted in the guide groove 107; a clamp bolt 109 configured to fix the clamp piece 108; a guide groove 104 formed on the upper surface of the table 4 and at the anti-operator side (rear side) beyond the protective cover 8; a clamp piece 105 fitted in the guide groove 104 in a freely movable manner in the Z-axis direction; and a clamp bolt 106 penetrating the backwardly protruding part 93 and the leg part 94 of the tooling base 9 in the up-down direction and configured to fix the clamp piece 105 at a required position in the guide groove 104 and fix the tooling base 9 to the table 4.

The other configuration is the same as that of the NC cylindrical grinder 1 of Embodiment 1. The tooling base 9 is guided in the Z-axis direction and is fixed at a required position, in the same manner as in the NC cylindrical grinder 1 of Embodiment 1.

According to the NC cylindrical grinder 500 of Embodiment 5, because the tooling base 9 is supported, at both of the front and rear end portions thereof, by the support member 301 and a leg part 94, support rigidity of the tooling base 9 is improved as compared with the NC cylindrical grinder 1 of Embodiment 1.

Also, although not shown, the guide mechanism capable of guiding the tooling base 9 in the Z-axis direction and fixing the tooling base 9 to the table 4 at a required position may include: a guide groove 101 having the shape of a dovetail groove, formed on the upper surface of the table 4 and at the operator side beyond the protective cover 8, and extending in the Z-axis direction; a clamp piece 102 fitted in the guide groove 101; a clamp bolt 103 penetrating the forwardly protruding part 91 and the leg part 92 of the tooling base 9 in the up-down direction and configured to fix the clamp piece 102 at a required position in the guide groove 101 and fix the tooling base 9 to the table 4; a guide groove 110 formed on the upper surface of the support member 401 provided at a rear portion of the table 4 in a fixed manner and extending in the Z-axis direction; a clamp piece 111 fitted in the guide groove 110 in a freely movable manner in the Z-axis direction; and a clamp bolt 112 provided so as to penetrate the backwardly protruding part 93 of the tooling base 9 in the up-down direction and configured to fix the clamp piece 111 at a required position in the guide groove 110 and fix the tooling base 9 to the table 4.

Also in this case, because the tooling base 9 is supported, at both of the front and rear end portions thereof, by the support member 401 and the leg part 92, support rigidity of the tooling base 9 is improved as compared with the NC cylindrical grinder 1 of Embodiment 1.

INDUSTRIAL APPLICABILITY

The cylindrical grinder according to the present invention is suitably used as an NC cylindrical grinder in which the tailstock is moved in the Z-axis direction according to the length of the workpiece to be machined by means of numerical control.

REFERENCE SIGNS LIST

1: NC cylindrical grinder
2: bed
4: table
5: headstock
6: NC tailstock
7: moving mechanism
8: protective cover
9: tooling base
92: leg part
94: leg part
101: guide groove
102: clamp piece
103: clamp bolt
104: guide groove
105: clamp piece
106: clamp bolt
107: guide groove
108: clamp piece
109: clamp bolt
110: guide groove
111: clamp piece
112: clamp bolt
200: NC cylindrical grinder
300: NC cylindrical grinder
301: support member
400: NC cylindrical grinder
401: support member
500: NC cylindrical grinder
W: workpiece

The invention claimed is:

1. A cylindrical grinder comprising: a base; a headstock arranged on said base and configured to rotatably support one end of a workpiece; a tailstock arranged on said base and configured to rotatably support another end of said workpiece; a moving mechanism provided to said base and configured to move at least either one of said headstock and said tailstock in a Z-axis direction, which is an axial direction of said workpiece; and a protective cover provided on said base and configured to protect said moving mechanism, wherein in an area between said headstock and said tailstock and at a height position above said protective cover, a tooling base for mounting a tooling instrument thereon is arranged in a freely movable manner in said Z-axis direction, and between said base and said tooling base, a guide mechanism being capable of guiding said tooling base in said Z-axis direction and fixing said tooling base to said base at a required position is provided, wherein to at least either one of a part toward an operator side beyond said protective cover and a part toward an anti-operator side beyond said protective cover, of said tooling base, a leg part extending downward is provided in a fixed manner, and said guide mechanism comprises:

a guide groove formed on an upper surface of said base and extending in said Z-axis direction;

a clamp piece fitted in said guide groove in a freely movable manner in said Z-axis direction; and a clamp bolt provided to said leg part of said tooling base and configured to fix said clamp piece at a required position in said guide groove and fix said tooling base to said base.

2. The cylindrical grinder according to claim 1, wherein at at least either one of a portion toward an operator side beyond said protective cover and a portion toward an anti-operator side beyond said protective cover, both on an upper surface of said base, a support member protruding upward and configured to support said tooling base is provided in a fixed manner, and said guide mechanism comprises:

a guide groove formed on an upper surface of said support member and extending in said Z-axis direction;

a clamp piece fitted in said guide groove in a freely movable manner in said Z-axis direction; and a clamp bolt provided to said tooling base and configured to fix said clamp piece at a required position in said guide groove and fix said tooling base to said base.

3. The cylindrical grinder according to claim 1, wherein to either one of a part toward an operator side beyond said protective cover and a part toward an anti-operator side beyond said protective cover, of said tooling base, a leg part extending downward is provided in a fixed manner, at either one of a portion toward the operator side beyond said protective cover and a portion toward the anti-operator side beyond said protective cover, both on an upper surface of said base, a support member protruding upward and configured to support said tooling base is provided in a fixed manner, with the support member being provided at the portion where the leg part is absent, and said guide mechanism comprises:

a first guide groove formed on the upper surface of said base and extending in said Z-axis direction;

a first clamp piece fitted in said first guide groove in a freely movable manner in said Z-axis direction;

a first clamp bolt provided to said leg part of said tooling base and configured to fix said first clamp piece at a required position in said first guide groove and fix said tooling base to said base;

a second guide groove formed on an upper surface of said support member and extending in said Z-axis direction;

a second clamp piece fitted in said second guide groove in a freely movable manner in said Z-axis direction; and a second clamp bolt provided to said tooling base and configured to fix said second clamp piece at a required position in said second guide groove and fix said tooling base to said base.

4. The cylindrical grinder according to claim 1, wherein said base is a table provided on a bed.

5. A cylindrical grinder comprising: a bed; a wheel spindle stock arranged on said bed; a table arranged on said bed and located on an operator side of said wheel spindle stock; a headstock arranged on said table and configured to rotatably support one end of a workpiece; a tailstock arranged on said table and configured to rotatably support another end of said workpiece; a moving mechanism provided to said table and configured to move at least either one of said headstock and said tailstock in a Z-axis direction, which is an axial direction of said workpiece; and a protective cover provided on said table and configured to protect said moving mechanism, wherein in an area between said headstock and said tailstock that are on said table, and at a height position above said protective cover, a tooling base for mounting a tooling instrument thereon is spaced apart from said protective cover and is arranged in a freely movable manner in said Z-axis direction; and between said table and said tooling base, a guide mechanism being capable of guiding said tooling base in said Z-axis direction and fixing said tooling base to said table at a required position is provided, and said tooling base has: an overlapping part that overlaps said protective cover as viewed in plan; and a protruding part that protrudes toward at least either one of the operator side and an anti-operator side beyond said protective cover and is configured to mount said guide mechanism thereon, said table has a projecting part that projects in a direction identical to that of said protruding part of said tooling base, that is, projects toward at least either one of the operator side and the anti-operator side beyond said protective cover, and between said protruding part and said projecting part provided on a side corresponding to that on which said protruding part is provided, said guide mechanism is provided.

* * * * *